US008175319B2

(12) United States Patent
Sumitani et al.

(10) Patent No.: US 8,175,319 B2
(45) Date of Patent: May 8, 2012

(54) INTERCHANGEABLE MAGNET LOUDSPEAKER

(75) Inventors: Yoichiro Sumitani, Rancho Palos Verdes, CA (US); Chun-Yi Lin, Xinzhuang (TW)

(73) Assignee: Sound Sources Technology, Inc.

( * ) Notice: Subject to any disclaimer, the term of this patent is extended or adjusted under 35 U.S.C. 154(b) by 826 days.

(21) Appl. No.: 12/137,237

(22) Filed: Jun. 11, 2008

(65) Prior Publication Data

US 2009/0310813 A1 Dec. 17, 2009

(51) Int. Cl.

| | |
|---|---|
| ***H04R 1/00*** | (2006.01) |
| ***H04R 9/06*** | (2006.01) |
| ***H04R 11/02*** | (2006.01) |

(52) U.S. Cl. ..... 381/397; 381/421

(58) Field of Classification Search ..... 381/397, 381/414, 396, 300, 412, 420, 421; 181/148, 181/153, 199

See application file for complete search history.

(56) References Cited

U.S. PATENT DOCUMENTS

| | | | | |
|---|---|---|---|---|
| 5,909,015 | A | 6/1999 | Yamamoto et al. | |
| 6,219,431 | B1 | 4/2001 | Proni | |
| 6,390,231 | B1 | 5/2002 | Howze | |
| 2005/0041831 | A1 | 2/2005 | Stiles et al. | |
| 2007/0177756 | A1 * | 8/2007 | Kemmerer | 381/397 |

* cited by examiner

*Primary Examiner* — Tuan Nguyen
(74) *Attorney, Agent, or Firm* — Stetina Brunda Garred & Brucker

(57) ABSTRACT

A moving coil loudspeaker has an interchangeable magnet assembly with a plurality of interchangeable magnet segments configured to be circumferentially disposed about a voice coil within the loudspeaker. Heat sink members can be arranged in between the magnet segments to absorb excess heat generated during operation of the loud speaker. In one embodiment, the magnet assembly has at least one annular magnetic member made up of the plurality of magnet segments, a plurality of heat sink members disposed in between the magnet segments, an annular first plate adjacent a first side of the annular magnetic member, and a yoke member having a second plate adjacent a second side of the annular magnetic member and a central cylindrical portion configured to pass through a central opening in the annular magnetic member.

16 Claims, 4 Drawing Sheets

INTERCHANGEABLE MAGNET LOUDSPEAKER

CROSS-REFERENCE TO RELATED APPLICATIONS

Not Applicable

STATEMENT RE: FEDERALLY SPONSORED RESEARCH/DEVELOPMENT

Not Applicable.

BACKGROUND

1. Technical Field

The present invention generally relates to acoustic transducers and manufacturing methods thereof. More particularly, the present invention relates to an interchangeable magnet and magnet assembly for loudspeakers, and methods for assembling loudspeakers utilizing the same.

2. Related Art

Loudspeakers are universally known and utilized in audio systems for the reproduction of sound. Essentially, loudspeakers are transducers which convert electrical energy to acoustic energy. There are a wide variety of designs employing various operational principles, and can be generally categorized as electrodynamic, electrostatic, piezoelectric, or discharge, among others.

The most common type of loudspeaker is of the electrodynamic variety, in which an electrical signal representative of the desired audio is applied to a voice coil wound around a bobbin and suspended between opposite poles of a magnet. The region between the poles is known as the air gap, and the magnetic field present therein interacts with the electrical current passed through the voice coil. The electromagnetic force moves the bobbin/voice coil along the air gap, and the displacement or movement thereof is controlled by the magnitude and direction of current in the coil and the resulting axial forces. The bobbin is also attached to a cone-shaped semi-rigid diaphragm, and the vibration of the bobbin is correspondingly transferred thereto. The base of the diaphragm is generally suspended from the rim of the loudspeaker basket, and provides lateral stability. The apex of the diaphragm generally includes a damper, also known in the art as a spider, a ring-shaped member having an interior edge that may be glued to the bobbin and an exterior edge that may be glued to the basket. The damper resiliently supports the bobbin at the respective predetermined static positions within the air gap without the voice coil contacting the surrounding surfaces of the yoke or the magnet.

A problem with conventional loudspeakers lies in the fact that the magnet used to generate the magnetic field can be susceptible to fracturing and breakage, such as when moving or transporting the loudspeaker, when the loudspeaker is exposed to extreme temperatures, or when the loudspeaker is operated at high power levels for excessively long periods of time. Breakage or fracturing of the magnet adversely affects the quality of sound generated by the loudspeaker by distorting the magnetic field generated by the magnet, and thus such damage to the magnet is, understandably, highly undesirable. Moreover, as it is typical in conventional loudspeakers to permanently affix the magnet to other components within the speaker frame, any repair of such conventional loudspeakers can require the complete disassembly of the loudspeaker, which is a labor-intensive process that often must be performed by a loudspeaker repair specialist. It is also not unusual for loudspeakers to have the magnet permanently affixed therein in a way that effectively eliminates options for repairing the loudspeaker. For example, disassembly of the loudspeaker may excessively damage other loudspeaker parts, or may be excessively labor intensive, such that the cost of the repair of the loudspeaker exceeds the overall replacement cost.

Yet another problem associated with many conventional loudspeakers is the generation of excessive levels of heat that can occur during operation thereof. The generation of heat can result from the application of electrical power to the voice coil, as a substantial portion of the electrical power is converted into heat, rather than sound. Excessive heat emitted from the voice coil can negatively impact the performance and longevity of the loudspeaker. For example, excessive heat can weaken the holding strength of adhesives used to attach pieces of the loudspeaker together, thereby structurally damaging the loudspeaker, and excessively high temperatures can even at least partially melt parts of the load speaker such as the wire insulation and other components. Excessive heat levels can even contribute to breakage of the loudspeaker magnet, for example by inducing excessive thermal expansion stresses in the magnet. The control of the heat generated during operation is so important for the optimal performance of the loudspeaker, that a factor typically used in industry to determine the power handling capacity of the speaker is in fact the ability of the device to tolerate heat. The heat tolerance of the speaker can be judged, for example, by the lowest melting point of the wire insulation and other components, as well as by the heat capabilities of the adhesive used to affix the coil.

Also, yet another effect that impairs performance of the speaker is the temperature induced resistance of the voice coil, also called the power compression of the voice coil. As the temperature of the voice coil rises, the DC resistance of the wire also increases. This resistance leads to a reduced efficiency for conversion of the received electrical signal to the acoustical output that becomes increasingly worse with increasing temperatures of the voice coil. Thus, as the voice coil becomes hotter, a higher voltage must be applied to achieve the same level of acoustic conversion, which higher voltage itself increases the temperature of the voice coil until a point is reached where further increases in the applied voltage results in virtually no increase in acoustical output and only a further increase in heat. The heating of the coil can thus produce undesirable non-linear loudness compression effects at high sound levels.

Various different methods have been attempted to provide "cooling" to the voice coil during operation of the loudspeaker, such as by venting the loudspeaker to provide a flow of air past the voice coil. Examples of such venting methods are described in U.S. Pat. No. 5,909,015 to Yamamoto et al, U.S. Pat. No. 6,219,431 to Proni and U.S. Pat. No. 6,390,231 to Howze, each of which is herein incorporated by reference in its entirety. For example, Yamamoto et al. describes a self-cooled loudspeaker having a permanent magnet assembly with a top plate stamped to form a plurality of intake and outtake air paths, where the movement of the diaphragm generates a unidirectional flow of air through the plurality of intake and outtake air paths. Proni describes a loudspeaker with a frame and motor structure, and a flow path in between the frame and top plate of the motor structure that directs air over at least a portion of the voice coil. Howze describes a loudspeaker having directed airflow cooling where an airflow director is provided to transfer heat away from a former to which the voice coil is attached.

However, a problem with such prior solutions is that they often do not provide adequate cooling of the voice coil and surrounding structures. For example, while venting may provide an initial release of hot air from the speaker, the hot air may also in certain instances be pulled back into the speaker, for example by movement of the diaphragm, such that operation of the loudspeaker for a sufficient duration merely results in the re-circulation of the hot air through the speaker. Also, vented loudspeakers may undesirably expose the interior of the loudspeaker to the surrounding environment, which exposure can introduce harmful particulate matter from the environment into the loudspeaker interior, as well as adversely affect the desired acoustic dynamics. For example, exposing the loudspeaker interior to the environment can attract magnetic particles into the interior of the speaker, which particles can interfere with the interaction of the magnet assembly and voice coil to distort the acoustic output.

Accordingly, there remains a need in the art for efficient and reliable means for effecting repair of loudspeakers having damaged magnets, such as methods and apparatus that allow for ready replacement of damaged magnets within a speaker. There further remains a need for an apparatus and method that provides for the control of temperatures within the loudspeaker in a manner that reduces heat damage incurred in components of the speaker, and which improves the acoustic performance of the speaker. There remains a further need in the art for an apparatus and method for controlling temperatures in the loudspeaker that does not require the presence of ports connecting the interior of the loudspeaker to the speaker exterior.

BRIEF SUMMARY

In accordance with the present invention, in one version there is provided an interchangeable magnet assembly for a loudspeaker. The magnet assembly has at least one annular magnetic member having first and second opposing sides and defining a central opening therein, with the annular magnetic member having a plurality of magnet segments. A plurality of heat sink members are configured to be disposed in between the magnet segments in the annular magnetic member. An annular first plate is configured to be positioned adjacent the first side of the annular magnetic member. A yoke member having a second plate is configured to be positioned adjacent the second side of the annular magnetic member. The yoke member has a central cylindrical portion configured to pass through the central opening in the annular magnetic member.

In yet another version, a moving coil loudspeaker has a speaker frame, a diaphragm mounted to the speaker frame and capable of movement therein, a voice coil connected to the diaphragm, the voice coil being capable of receiving an electrical current and moving the diaphragm in response to an interaction of the electrical current with a magnetic field, thereby generating an acoustic output, and a magnet assembly configured to generate the magnetic field that interacts with the electrical current received by the voice coil. The magnet assembly has at least one annular magnetic member defining a central opening therein and a yoke member extending therethrough, the annular magnetic member and yoke member defining an air gap therebetween into which the voice coil at least partially extends. The annular magnetic member has a plurality of magnet segments disposed circumferentially about the voice coil.

In yet another version, a method of assembling a moving coil loudspeaker includes mounting a diaphragm on a speaker frame, connecting a voice coil to the diaphragm, and positioning the plurality of magnet segments of the magnet assembly circumferentially about the voice coil. The magnet segments can be positioned by assembling the magnet assembly according to the steps of arranging the plurality of magnet segments in between a first plate and a second plate to form a plurality of annular magnetic layers defining a central opening, the second plate being a part of the yoke member and having a central cylindrical portion that passes through the central opening in the annular magnetic layers, positioning a plurality of heat sink members in between adjacent magnet segments of the magnetic layers, and securing the plurality of annular magnetic layers, plurality of heat sinks, and first and second plates to one another by passing fastening members through the plurality of heat sinks and between the first and second plates.

In still a further version, a method of refurbishing or repairing a moving coil loudspeaker having a magnet assembly with a plurality of magnet segments includes detaching at least a portion of a magnet assembly from the rest of the moving coil loudspeaker, interchanging one or more of the magnet segments of the magnet assembly with other magnet segments, and reattaching the magnet assembly to the rest of the moving coil loudspeaker.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

Figures 1, 2, 3:
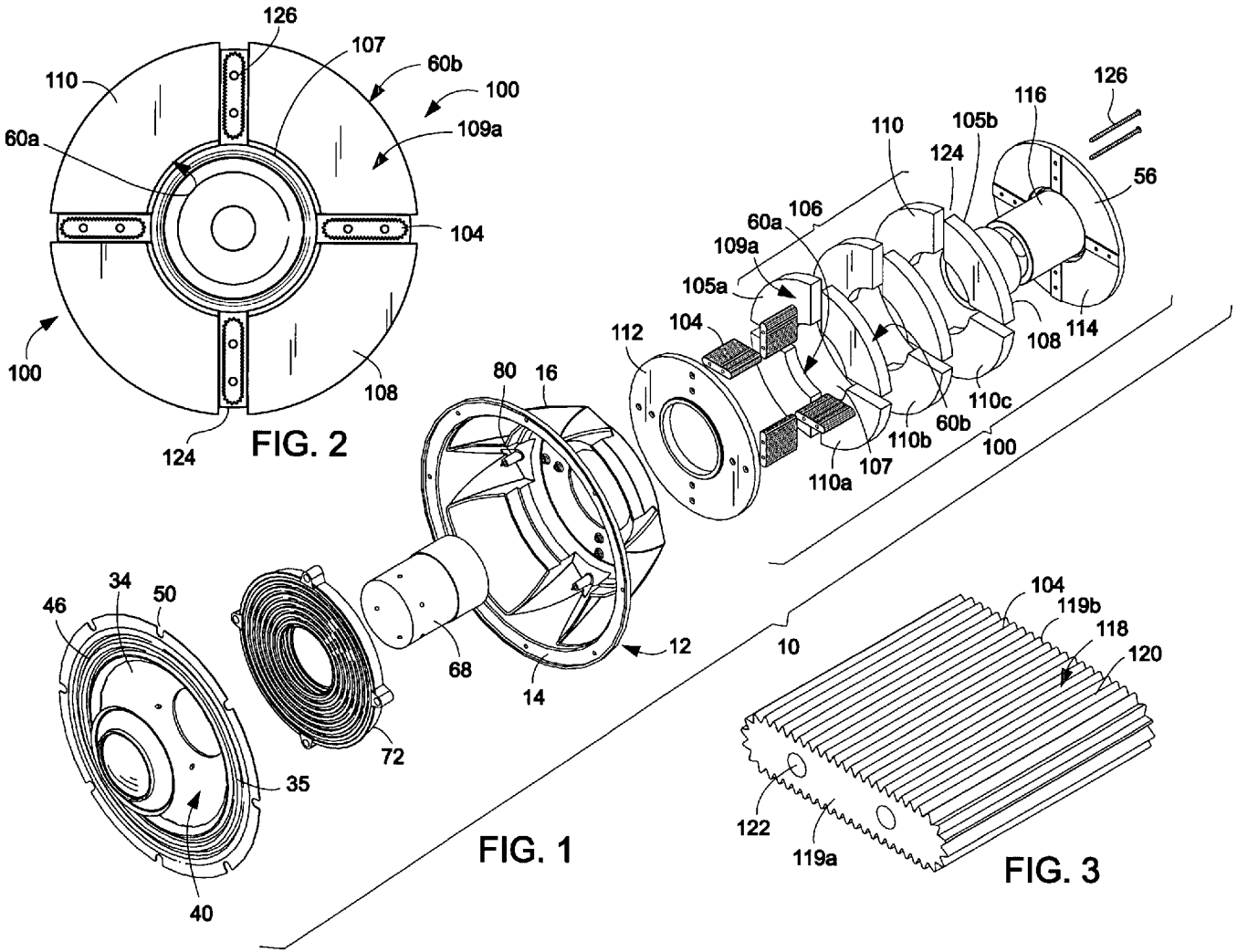
FIG. 1 is an exploded perspective side view of an embodiment of a moving coil loudspeaker having an interchangeable magnet assembly according to one version of the invention.
FIG. 2 is a cross-sectional view of the version of the interchangeable magnet assembly shown in FIG. 1.
FIG. 3 is a perspective side view of an embodiment of a heat sink member according to one version of the invention.

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention. It is further understood that the use of relational terms such as first and second, top and bottom, and the like are used solely to distinguish one from another entity without necessarily requiring or implying any actual such relationship or order between such entities.

An interchangeable magnet assembly 100 has been discovered that allows for ready repair and/or replacement of magnet components or the entire magnet assembly 100 in moving coil loudspeakers 10, such as when breakage or fracturing of a magnet component occurs. The improved magnet assembly 100 also beneficially allows tailoring of the loudspeaker response by ready interchangeability of magnet components to achieve a desired acoustic output. In one version, the improved magnet assembly 100 comprises a plurality of magnet segments 108 that can be readily interchanged and/or replaced as needed, thereby increasing the durability and versatility of the loudspeaker 10. In another version, the improved magnet assembly 100 comprises a plurality of heat sinks 104 capable of absorbing heat generated by the voice coil 70 to improve the loudspeaker heat tolerance and acoustic performance. Thus, the interchangeable magnet assembly 100 is capable of increasing the longevity and improving the performance of loudspeakers 10 equipped with the assembly 100.

Figure 5A:
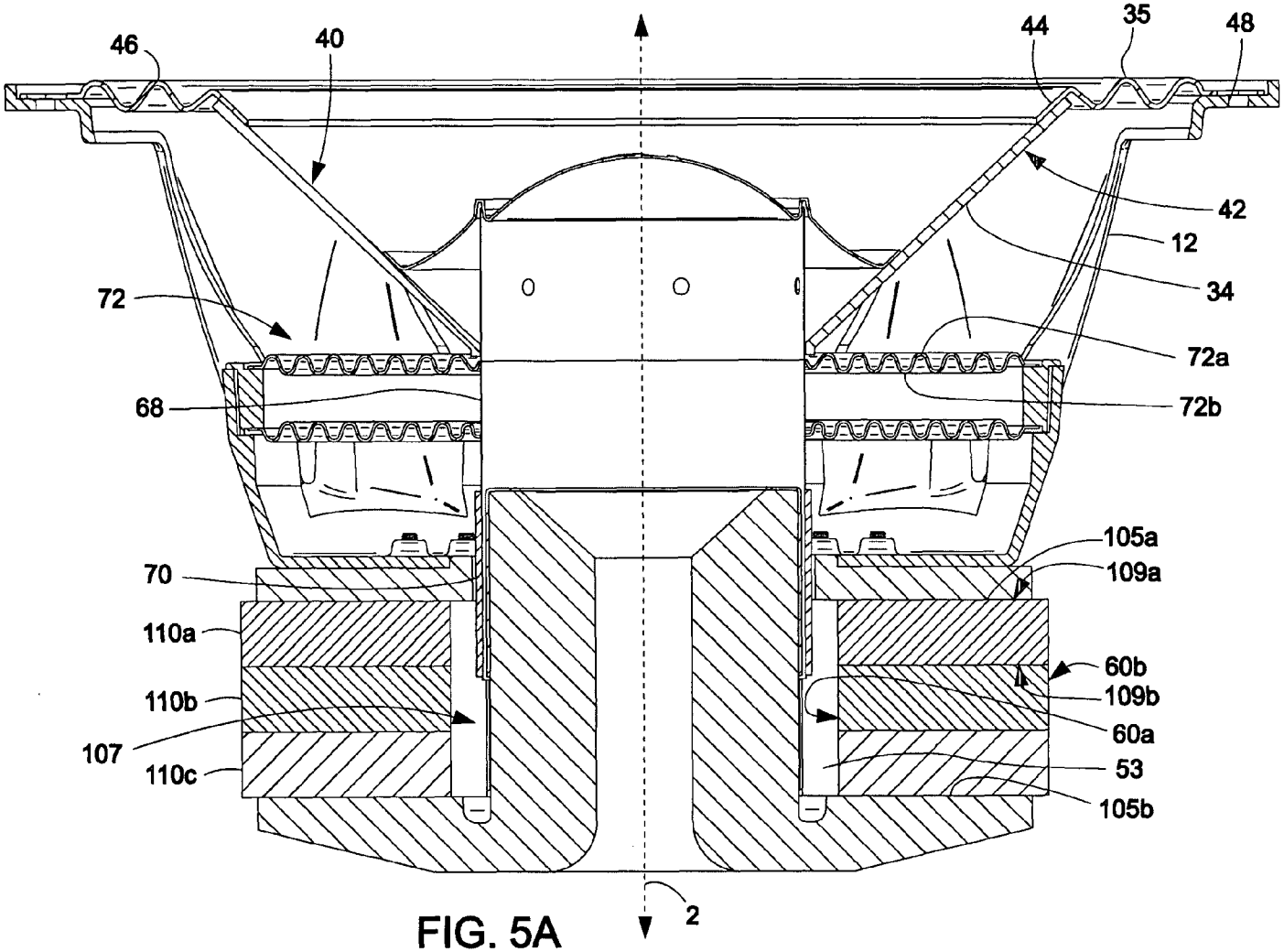
FIGS. 5A-5B are cross-sectional side views of the moving coil loudspeaker having the interchangeable magnet assembly of FIGS. 4A-4C.

FIG. 1 is an exploded side view of an embodiment of a loudspeaker 10 having an interchangeable magnet assembly 100 according to the invention. As can be seen from this figure, the magnet assembly 100 generally comprises at least one annular magnetic member 106 having a plurality of magnet segments 108. The annular magnetic member 106 has first and second opposing sides 105*a*, 105*b* and defines a central opening 107 therein. The central opening 107 may be sized and shaped to encircle an opposing magnetic pole, such as a central cylindrical portion 116 of a yoke member 56, as is also shown in FIG. 5A. The central opening 107 is also preferably sized and shaped to at least partially encircle a portion of the voice coil 70 and air gap 53. The magnet assembly 100 having the annular magnetic member 106 thus provides the magnetic field in the air gap 53 that interacts with an electrical current received in the voice coil 70 to produce an acoustic output.

FIG. 2 shows a top view of an embodiment of the annular magnetic member 106 provided as a part of the interchangeable magnet assembly 100 according to the instant invention. In the version as shown, the annular magnetic member 106 comprises discrete magnet segments 108 that are arranged to form a ring-like shape having the central opening 107. Thus, when inserted into the loudspeaker 10, the magnet segments 108 are disposed circumferentially about the central cylindrical portion 116 of the yoke member 56, and at least partially about the voice coil 70 and air gap 53. The magnet segments 108 are made of a magnetic material that generates a magnetic field capable of interacting with the voice coil 70 to produce an acoustic output, such as for example any of the magnetic materials conventionally used in loudspeakers, including permanent magnet materials.

The magnet segments 108 making up the annular magnetic member 106 are sized, shaped and configured to provide the desired magnetic field profile, and may also be selected to facilitate interchangeability of the magnet segments. For example, in the version shown in FIG. 2, the magnet segments 108 comprise arcuate magnet segments 108 that are capable of being circumferentially aligned with respect to one another to form the annular magnetic member 106. As can be seen from this figure, the arcuate magnet segments 108 correspond to semi-circular sections of an annular ring, with each segment 108 having substantially planar top and bottom surfaces 109*a*, 109*b*, and having curved or arching interior and exterior surfaces 60*a*, 60*b* that are substantially parallel to one another. Each magnet segment 108 may comprise substantially the same size, shape and configuration as the other segments 108, or alternatively the plurality of magnet segments 108 can comprise segments with varying shapes and sizes. Preferably, the magnet segments 108 are sized, shaped and configured to provide a radially symmetric distribution of the segments 108 about a central axis 2 of the loudspeaker 10. It should be furthermore understood that while the magnet segments 108 are exemplified as having arcuate shapes, the magnet segments 108 could also or alternatively comprise shapes and sizes other than those specifically shown.

The embodiment shown in FIG. 2 illustrates magnet segments 108 of the annular magnetic member 106 that are sized, shaped and configured to define passages 124 in between adjacent segments 108. The passages 124 formed between the magnet segments 108 provide advantages in that they allow for the insertion of heat sink members 104 therein to absorb excess heat from the magnets, as is discussed in further detail below. However, it should also be understood that the magnet segments 108 could be sized and shaped in alternative embodiments such that adjacent segments 108 are abutting one another substantially without any passages 124 therebetween, or such that only selected adjacent segments 108 contain passages 124 therebetween.

An advantage of providing the annular magnetic member 106 in the form of magnet segments 108 is that the segments 108 may be readily interchanged with one another or replaced upon breakage or fracturing of the segments 108. The magnet segments 108 may also be readily interchangeable to select a desired magnetic field profile, such as by selecting segments 108 having different magnetization values M, thereby tailoring the loudspeaker acoustic response. The segments 108 making up the annular magnetic member 106 may also be less susceptible to such fracturing or breakage than an un-segmented member, and in particular less susceptible to thermal heat expansion-induced fracturing or breakage of the segments. Thus, the annular magnetic member 106 comprising the magnet segments provides substantial improvements in the durability and performance of the loudspeaker 10, and may also increase the acoustic versatility of the magnet assembly 100.

Returning to the embodiment shown in FIGS. 1 and 5A, it is shown that the annular magnetic member 106 can be formed from a plurality of magnet layers 110 that are stacked together or otherwise axially aligned along a central axis 2 of the loudspeaker 10, with at least one of the magnet layers 110 comprising the plurality of magnet segments 108. The number of magnet layers 110 provided can be selected according to the magnetic field desired, as well as according to the desired configuration of the magnet assembly 100. For example, in the version shown in FIGS. 1 and 5A, the annular magnetic member 106 comprises three magnet layers 110*a*-110*c*, with each magnet layer 110 comprising four magnet segments 108. Alternatively, the annular magnetic member 106 could comprise other suitable numbers of magnet layers 110 and/or magnet segments 108, such as from two to five stacked magnet layers 110, with each magnet layer 110 comprising for example from two to six magnet segments 108. Furthermore, while FIGS. 1 and 5A show an embodiment in which each magnet layer 110 is formed from a plurality of magnet segments 108, it should be understood that one or more of the magnet layers 100 could also optionally be formed of an unsegmented annular magnet layer, such as a ring-shaped, unitary magnet. Providing the annular magnetic member 106 in the form of a plurality of magnet layers 110 has advantages similar to those obtained by providing a plurality of magnet segments 108, in that for example each individual layer 110 can be readily replaced or interchanged as needed should breakage or fracturing of the magnet layer 110 or segments 108 therein occur. A plurality of relatively smaller individual magnet layers 110 and/or smaller segments 108 may also be less susceptible to breakage than a single relatively large magnetic ring, and in particular may be less susceptible to fracturing due to thermal expansion stresses. Also, the magnetic properties of each layer 110 can be selected to provide a desired magnetic field in the air gap 53 of the loudspeaker 10. For example, each magnet layer 110*a*-110*c* can each be formed of a magnetic material having the same or different magnetization values M that are selected according to the profile of the magnetic field that is desired. Also, while the each of the magnet layers 110 in the magnet layer stack are depicted as being of substantially the same shape and size in FIGS. 1 and 5A, it should be understood that the layers 110 can alternatively have different shapes and configuration, such as different axial widths and/or different radii, although the layers 110 preferably comprise a radial symmetry about the central axis 2 of the loudspeaker 10.

In one version, the magnet assembly 100 comprises at least one and even a plurality of heat sink members 104, as shown for example in FIGS. 1-3 and 5B. The heat sink members 104 are capable of absorbing excess heat generated by components of the loudspeaker 10 during operation thereof, such as excess heat generated by the voice coil 70, to improve speaker performance and reduce heat-induced damage to the loudspeaker components. The heat sink members 104 are disposed within the magnet assembly 100 in a manner that allows for the transfer of excess heat to the heat sink members 104. For example, in the version depicted in FIG. 2, the heat sink members 104 are disposed in between adjacent magnet segments 108 in a magnet layer 110, such as in the passages 124 formed in between the adjacent magnet segments 108. Referring to the embodiments shown in FIGS. 1 and 5B, it can be seen that the magnet segments 108 in each magnet layer 110 can be axially aligned with respect to one another such the passages 124 formed between adjacent segments 108 also pass through the plurality of magnet layers 110. In this version, the heat sink member 108 can be inserted into the multi-layer passages 124, and can be sized, shaped and configured to thus extend along a selected width of the annular magnetic member 106, such as from a first layer 110*a* at the first end 105*a* of the annular magnetic member 106 to an end layer 110*c* at the second end 105*b* of the annular magnetic member 106. The heat sink member 108 is thus capable of absorbing heat from each of the layers 110*a*-110*c* to control the temperatures of the magnet layers 110, as well as to absorb heat from loudspeaker components such as the voice coil 70 that are in proximity to the magnet layers 110. While an exemplary embodiment of the heat sink member 104 arrangement within the magnet assembly 100 is shown, it should be understood that the heat sink members 104 can also be arranged with respect to the magnet segments 108 in ways other than those specifically illustrated, such by providing a plurality of different heat sink members in each layer 110 of the annular magnetic member 106, by omitting one or more heat sink members between segments 108 in each layer 110, or according to other arrangement suitable to control temperatures within the loudspeaker 10.

FIG. 3 shows a schematic side view of an embodiment of a heat sink member 104 suitable for the magnet assembly 100. The heat sink member 104 comprises a surface 118 having a plurality of projections 120 thereon to increase the surface area, and thus the heat absorption capabilities, of the heat sink member 104. For example, the heat sink member 104 can comprise a saw-tooth shaped or serrated surface 118, or other type of increased surface-area surface. In the version shown in FIG. 3, the heat sink member 104 comprises a generally rectangular shape modified with rounded edges along the length of the member 104 and is sized, shaped and configured to be fit lengthwise into the passages 124 formed between the magnet segments 108, as shown for example in FIGS. 1-2. In this version, the surface 118 having the increased surface area projections 120 and/or serrations wraps width-wise about substantially the entire heat sink member 104, with only the first and second opposing ends 119*a*, 119*b* of the heat sink member 104 being left unserrated. The individual projections 120 or serrations form a series of ridges that extend generally parallel to one another lengthwise along the surface 118 of the heat sink member 104, running from the first end 119*a* of the heat sink member 104 to the second end 119*b*. The heat sink member 104 can also be made of one or more materials having relatively high heat capacities $C_p$ to facilitate the transfer of excess heat to the heat sink member 104. The version of the heat sink member 104 shown in FIG. 3 further comprises one of more holes 122 formed therein that pass through the body of the heat sink member 104, and which allow the heat sink members 104 to be secured within the magnet assembly 100.

Returning to the embodiment shown in FIG. 1, the magnet assembly 100 can further include an annular first plate 112 that is configured to be positioned adjacent the first side 105*a* of the annular magnetic member 106, and yoke member 56 comprising a second plate 114 configured to be positioned adjacent the second side 105*b* of the annular magnetic member 106. The yoke member 56 also comprises the central cylindrical portion 116 that is configured to pass through the central opening 107 in the annular magnetic member 106. In one version the portions of the yoke member 56 such as the second plate 114 and central cylindrical portion 116 are formed unitarily with one another, as shown for example in FIGS. 1 and 5B. Alternatively, the yoke member 56 can be formed of separate pieces such as separate plate 114 and cylindrical portions 116 that are affixed to one another, and can also comprise any other suitable configuration. The first and second plate 112, 114 may serve to at least partially secure the annular magnetic member 106 comprising the plurality of magnet segments 108 therebetween within the magnet assembly 100.

Figure 4A:
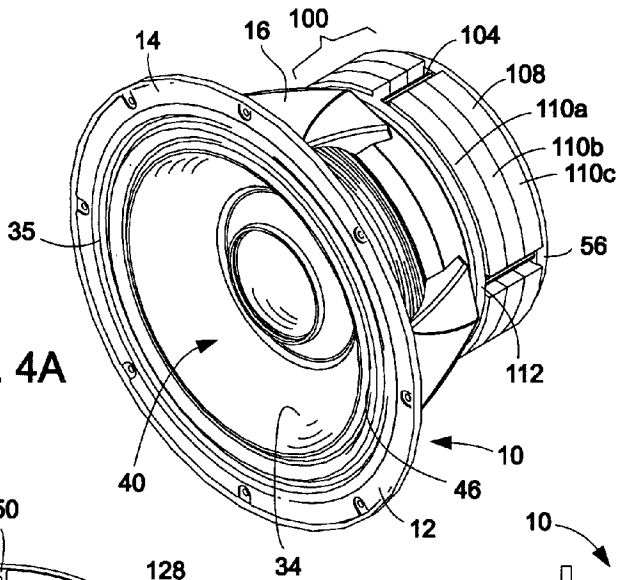
FIGS. 4A-4C are perspective front, top and side views, respectively, of an embodiment of a moving coil loudspeaker having an interchangeable magnet assembly according to one version of the invention.
Figure 4C:
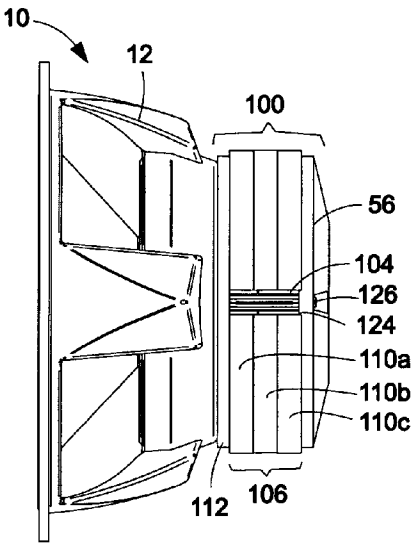
Figure 4B:
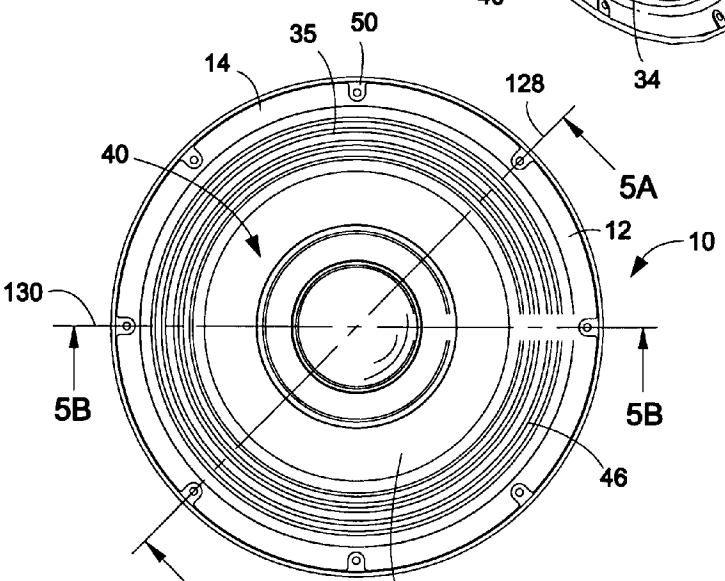
Figure 5B:
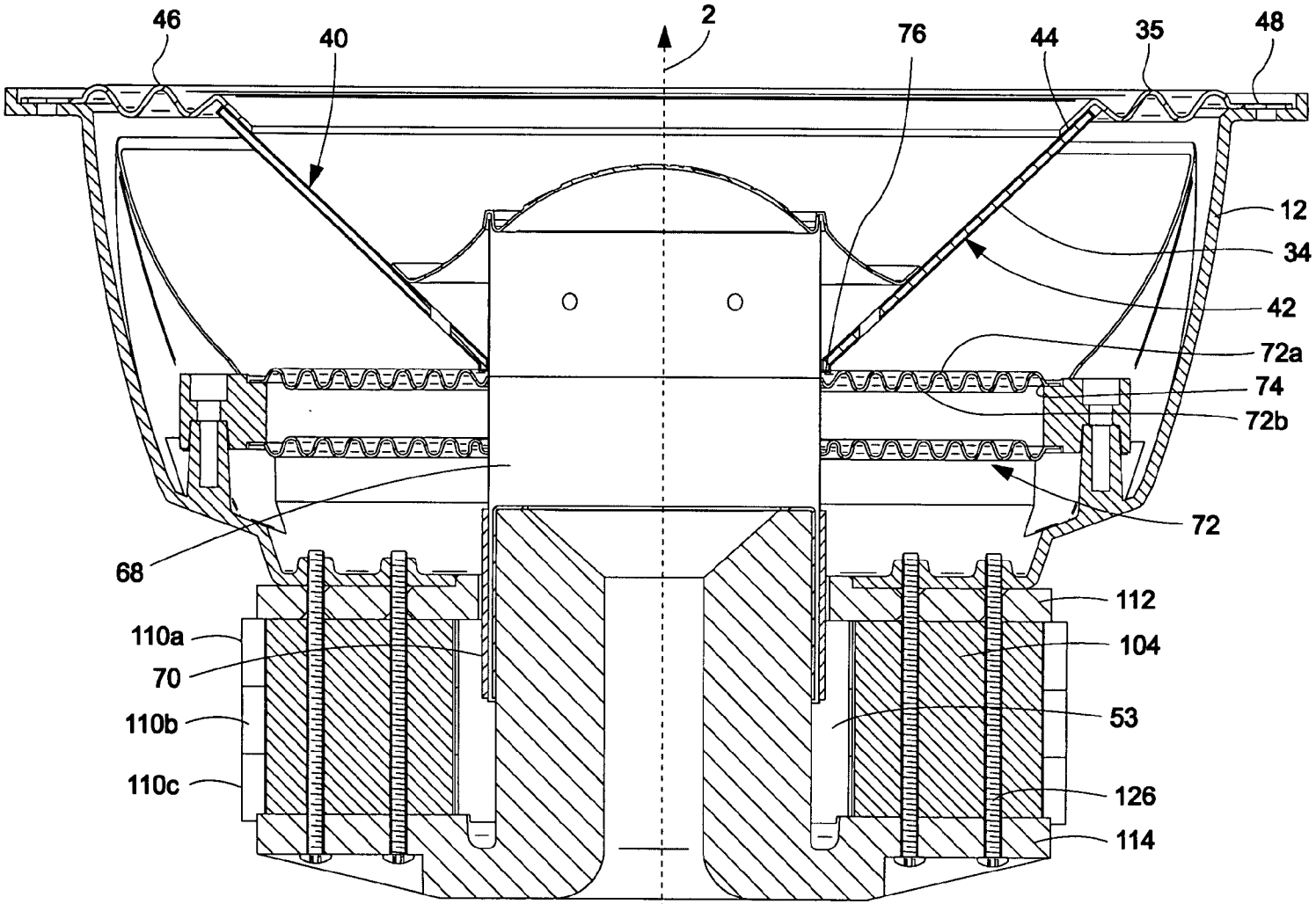

Perspective views of embodiments of the moving coil loudspeaker 10 having the interchangeable magnet assembly 100 are shown in FIGS. 4A-4C, with FIG. 4A showing a perspective front view, FIG. 4B showing a perspective top view, and FIG. 4C showing a perspective side view of the moving coil loudspeaker 10. Comparison of FIG. 4B with FIGS. 5A and 5B shows the alignment of the adjacent magnet segments 108 and heat sink members 104 in the plurality of stacked magnet layers 110 in one version of the magnet assembly 100. For example, the cross-sectional line 128 of FIG. 4B can be understood to correspond to the cross-sectional side view of FIG. 5A, which depicts the stacked layers 110*a*-110*c* of the magnet assembly 100. The cross-sectional line 130 of FIG. 4B is rotated approximately 45° from the first cross-sectional line 128, and can be understood to correspond to the cross-sectional side view of FIG. 5B, which depicts heat sink members 104 passing through the annular magnetic member 106 between the first and second plates 112, 114 in the passages 124 formed in between adjacent magnet segments 108. FIGS. 4A and 4C show suitable arrangements of the magnet assembly 100 attached to the loud speaker 10, with FIG. 4C also depicting a fastener 126 passing through the heat sink member 104 and used to secure the components of the magnet assembly 100 together and/or to the loudspeaker frame 12.

One embodiment of a method of assembling the magnet assembly 100 is described in further detail with reference to FIGS. 1 and 5A-5B. As can be seen, the annular magnetic member 106 is formed by arranging the magnet segments 108 in a generally circumferential alignment. For an annular magnetic member 106 comprising a plurality of stacked layers 110, the plurality of magnet segments 108 are stacked between the first and second plates 112, 114, with the central cylindrical portion 116 of yoke member 56 passing through the central opening 107 of the annular magnetic member 106. The heat sink members 104 are positioned in between adjacent magnet segments 108 of the magnetic layers 110, such as by inserting into passages 124 defined by adjacent magnet segments 108 that are aligned with respect to each other in each layer 110. The heat sink members 104 can also be positioned in between adjacent magnet segments 108 by placing the heat sink members 104 in a desired configuration and then arranging the individual magnet segments 108 about the pre-placed heat sink members 104. In yet another embodiment, a first layer 110*a* of magnet segments 108 can be arranged, the heat sink members 104 can be positioned between the segments 108, and the remaining layers 110 of the magnet segments can be arranged according to the desired configuration. It should be understood that other sequences and/or steps for arranging the magnet segments 108, heat sink members 104 and/or first and second plates 112, 114 other than those specifically described can also be performed to assemble the magnet assembly 100. In the version shown, the magnet assembly 100 is secured together by passing one or more fasteners 126 through the heat sink members 104 and the first and second plates 112, 114, thereby clamping the first and second plates 112, 114 together to hold the magnet segments 108 therebetween. For example, with reference to FIG. 5B, the fasteners 126 (2 per heat sink member 104 in the embodiment shown) can be inserted into the magnet assembly 100 such that they extend from the outside of the second plate 114, through the heat sink members 104, and continue through the first annular plate 112 until the ends of the fasteners 126 are received into holes formed in the bottom of the speaker frame 12. The fasteners 126 can comprise, for example, aluminum screws, although other means of fastening and securing the magnet assembly may also be used. The fasteners 126 can also be used to affix the magnet assembly 100 to the loudspeaker frame 12, such as by inserting the ends of the fasteners 126 into the frame 12 to secure the magnet assembly 100 thereto.

Removal of the magnet assembly 100 from the frame 12 and/or the rest of the loudspeaker 10 can therefore proceed by undoing the fasteners 126 to release at least a portion and even the entire magnet assembly 100, from the frame 12. The magnet segments 108 can be removed or interchanged from the thus-released magnet assembly 100 with other magnet segments 108 by any of the methods as described herein. Alternatively, the magnet segments 108 can be removed or interchanged by only partially undoing the fasteners 126 to the extent the magnet segments 108 become releasable from in between the clamped first and second plates 112, 114, without entirely releasing the magnet assembly 100 from the loudspeaker 10. Once the desired repair and/or modification of the magnet assembly 100 has taken place, the magnet assembly 100 can be reattached to the loudspeaker 10 by any of the methods described above. The repair and/or refurbishment may also involve replacing one or more of the heat sink members 104 and/or one or more of the first and second plates 112, 114, and can even involve complete replacement of the magnet assembly 100 with a new assembly 100. Thus, the interchangeable magnet assembly 100 provides a relatively efficient and simple means for removal of the assembly 100 and/or magnet segments 108 therein to facilitate easy repair, refurbishment and/or modification of loudspeaker 10.

With reference to the exploded schematic view of FIG. 1, as well as the front, top and side views of FIGS. 4A-4C and the cross-sectional views of FIGS. 5A-5B, a preferred embodiment of a moving coil loudspeaker 10 in accordance with an aspect of the present invention is illustrated. The loudspeaker 10 generally comprises a basket 12 having a front rim 14 and a basket base 16, and is coaxial with the central axis 2. The basket 12 is otherwise known in the art as a frame, and the two terms are deemed to be interchangeable. Generally, the basket 12 is circularly shaped, although the present invention need not be limited thereto. It will be appreciated the basket 12 may have other shapes, such as an oval shape, without departing from the scope of the present invention. Along these lines, when referring to a feature of the present invention having a "circular" shape hereinbelow, one of ordinary skill in the art will recognize that such feature may have an alternative shape as indicated above. It will be understood that one or more fastening members (not shown) may be inserted through mounting holes formed in the front rim 14 to mount the basket 12 to an enclosure or other structure.

For enhancing the decorative appearance of the face of the loudspeaker 10, there is provided a grille that may include a mesh-like element that covers the entire face of the loudspeaker 10, but as understood in the art, the grille need not include such an element, and any decorative piece attached to the front rim 14 may be so referenced. The grill can include a façade that incorporates ornamental designs that are engraved, painted, or otherwise impressed thereupon. In addition to its decorative functions, the grille can serve to cover any mounting holes and any fastening members (not shown) inserted through the basket 12 to mount the loudspeaker 10 to an enclosure or other structure.

The loudspeaker 10 further includes a diaphragm 34 mounted to the front rim 14 via an annular surround 35. As indicated above, the diaphragm 34 is also known in the art as a cone, and the following description will refer to parts of the diaphragm 34 using terms commonly associated with a geometrically conical structure. The front face 40 of the diaphragm 34 is characterized by a concave surface, while the opposing back face 42 is characterized by a convex surface. As will be recognized by one of ordinary skill in the art, the diaphragm may be constructed of paper, polypropylene, carbon-fiber composite material, Kevlar, or any other material suitable for acoustic applications.

The annular surround 35 is characterized by a diaphragm attachment portion 44, a wave-shaped central flexing portion 46, and a rim attachment portion 48. The diaphragm attachment portion 44 is slightly angled with respect to the orientation of the rim attachment portion 48, and accommodates the contour of the diaphragm 34. While in the exemplary embodiment the diaphragm 34 is adhesively attached to the diaphragm attachment portion 44, any other well known diaphragm-surround junction may be readily substituted without departing from the present invention. For example, the surround 35 may be co-molded with the diaphragm 34. The central wave-shaped flexing portion 46 has a plurality of folds, i.e. "waves" that contract and expand in conjunction with the reciprocating motion of the diaphragm along the central axis 2. In this regard, the annular surround 35 provides lateral stability and limits the range of motion of the diaphragm 34 to prevent damage to the loudspeaker 10. While the diaphragm 34 is constructed of relatively rigid material as indicated above, the surround 35 can be constructed of a softer and more flexible material, such as foam rubber. The rim attachment portion 48 is generally flat, and extends in a co-planar relationship to the front rim 14. With additional reference to FIGS. 1 and 4A-4B, the rim attachment portion 48 can include one or more notches 50 to accommodate any fastening members inserted through holes in the front rim 14 and/or grille.

The loudspeaker 10 further includes the magnet assembly 100 as described above. The magnet assembly 100 comprises the annular magnetic member 106 that is made up of, for example, one or more magnet layers 110 each comprising a plurality of magnet segments 108. The annular magnetic member 106 is disposed between a top plate 112 and the yoke member 56, which comprises a generally T-shaped yoke 56 including the second plate 116 and the central cylindrical portion 116. The annular magnetic member 106 defines a central circular opening 58 therein, defined by the inner surfaces 60*a* of the individual magnet segments 108. The yoke 56 includes the second plate 114 and the central cylindrical portion 116 that is generally oriented perpendicularly thereto. The cylindrical portion 116 extends through the central circular opening 58 of the annular magnetic member 106, and in conjunction with the top plate 112, defines an air gap 53. The air gap 53 is cylindrical, that is, it conforms to the cylindrical portion 116 and the central circular opening.

The air gap 53 is cylindrical in order to accommodate the cylindrical configuration of the bobbin 68. The bobbin 68 is positioned such that a voice coil 70 disposed thereon rests within the air gap 53. The voice coil 70 is a coil of lightweight wire wrapped around the bobbin 68 and has one or more lead lines connected to an electrical current/audio source. As is well known, the current transmitted through the voice coil 70 induces an electromagnetic field, and by interacting with the magnetic field present in the air gap generated by the permanent magnet 52, the bobbin 68 reciprocates along the central axis 2. The bobbin 68 is mounted to the diaphragm 34, and also to a damper 72. The damper 72 is annular and is corrugated, that is, it is comprised of a series of concentric ridges 72*a* and peaks 72*b*, permitting the same to flex along the central axis 2. The damper 72 can be constructed of a rigid woven fabric, giving it a degree of resiliency. Along these lines, the damper 72 defines an outer rim 74 fixed to the basket 12, and an inner rim 76 for attachment to the bobbin 68.

The electrical current/audio source is connected to the loudspeaker 10 via a terminal 80 attached to the basket 12. It will be appreciated by one of ordinary skill in the art that any suitable terminal type may be utilized, including banana plug receptacles, bare wire clips, and so forth. Generally, as is the case with the illustrative embodiment, the terminal 80 is disposed on the outer periphery of the basket 12, while the voice coil 70 is disposed in the central region of the same. To transfer the electrical current from the terminal 80 to the voice coil 70, there are one or more connecting wires (not shown) extending therebetween.

In one version of a method of assembling the moving coil loudspeaker 10, a diaphragm 34 is mounted on the speaker frame 12 and the voice coil 70 is connected to the diaphragm 34, such as for example by any of the conventional methods used in the manufacture of moving coil loudspeakers 10. An example of a method of assembling a moving coil loudspeaker 10 can be found, for example, in U.S. patent application Ser. No. 11/542,047 to Sumitami et al, entitled "Loudspeaker Bobbin Interconnection Assembly," the entire disclosure of which application is herein being incorporated by reference in its entirety. The interchangeable magnet assembly 100 is incorporated into the loudspeaker 10 by positioning a plurality of the magnet segments 108 of the magnet assembly 100 circumferentially about the voice coil 70. In one version, the magnet assembly 100 is first assembled, for example by any of the methods described herein, after which the assembly 100 is mounted onto the loudspeaker 10 such that the magnet segments 108 are positioned in the desired arrangement about the voice coil 70.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. An interchangeable magnet assembly for a loudspeaker, the magnet assembly comprising:

at least one annular magnetic member having first and second opposing sides and defining a central opening therein, the annular magnetic member comprising a plurality of magnet segments;

a plurality of heat sink members configured to be disposed in between the magnet segments in the annular magnetic member;

an annular first plate configured to be positioned adjacent the first side of the annular magnetic member; and a yoke member comprising a second plate configured to be positioned adjacent the second side of the annular magnetic member, and a central cylindrical portion configured to pass through the central opening in the annular magnetic member.

2. The magnet assembly according to claim 1, wherein the magnet segments are interchangeable.

3. The magnet assembly according to claim 1, wherein the annular magnetic member comprises a plurality of stacked magnet layers, each magnet layer comprising a plurality of the magnet segments.

4. The magnet assembly according to claim 3, wherein the plurality of magnet segments comprises a plurality of arcuate magnet segments.

5. The magnet assembly of claim 4 wherein the heat sink members are configured to be disposed in between adjacent arcuate segments in each magnet layer.

6. The magnet assembly according to claim 5, wherein the annular magnetic member comprises from two to five stacked magnet layers, each magnet layer comprising from two to six arcuate magnet segments.

7. The magnet assembly according to claim 6 wherein the arcuate magnet segments in each layer are aligned with arcuate magnet segments in the remaining layers, and wherein the heat sink members are sized, shaped and configured to extend along the width of the magnetic member in between the aligned arcuate magnet segments of the stacked magnetic layers.

8. The magnet assembly according to claim 1, wherein the heat sink members each comprise a surface having a plurality of projections thereon to increase the surface area of the heat sink.

9. The magnet assembly according to claim 8, wherein the heat sink members each comprise a serrated surface.

10. A moving coil loudspeaker comprising:

a speaker frame;

a diaphragm mounted to the speaker frame and capable of movement therein;

a voice coil connected to the diaphragm, the voice coil being capable of receiving an electrical current and moving the diaphragm in response to an interaction of the electrical current with a magnetic field, thereby generating an acoustic output; and a magnet assembly configured to generate the magnetic field that interacts with the electrical current received by the voice coil, the magnet assembly comprising:

at least one annular magnetic member having first and second opposing sides and comprised of a plurality of magnet segments, the annular magnetic member defining a central opening therein;

a yoke member extending through the annular magnetic member, together with the yoke member further defining an air gap therebetween into which the voice coil at least partially extends, wherein the magnet segments are disposed circumferentially about the voice coil, the yoke member including a second plate disposed adjacent to the second side of the annular magnetic member and including a central cylindrical portion that passes through the central opening in the annular magnetic member;

a plurality of heat sink members configured to absorb heat generated by the voice coil and being configured to be disposed in between the magnet segments in the annular magnetic member; and a first annular plate disposed adjacent to the first side of the annular magnetic member.

11. The loudspeaker of claim 10 wherein the magnet assembly comprises a plurality of interchangeable magnet segments.

12. The loudspeaker of claim 10 wherein the magnet assembly comprises a plurality of arcuate magnet segments.

13. The loudspeaker of claim 12 wherein the magnet assembly comprises a plurality of stacked magnet layers, each magnet layer having a plurality of the arcuate magnet segments.

14. The loudspeaker of claim 13, wherein the magnet assembly comprises from two to five stacked magnet layers, and wherein each magnet layer comprises from two to six arcuate magnet segments.

15. The loudspeaker of claim 10 wherein the heat sink members each comprise a surface having a plurality of projections thereon to increase the surface area of the heat sink.

16. The loudspeaker of claim 10 wherein the annular magnetic member comprises a plurality of stacked magnet layers, each magnet layer comprising a plurality of arcuate magnet segments, wherein the arcuate magnet segments in each magnet layer are aligned with arcuate magnet segments in the remaining layers of the annular magnetic member, and wherein the heat sink members are shaped, sized and configured to extend along a width of the annular magnetic member in between the aligned arcuate magnet segments of the stacked magnet layers.

* * * * *